US009587578B2

(12) United States Patent
Surnilla et al.

(10) Patent No.: US 9,587,578 B2
(45) Date of Patent: Mar. 7, 2017

(54) ADAPTIVE LEARNING OF DUTY CYCLE FOR A HIGH PRESSURE FUEL PUMP

(71) Applicant: Ford Global Technologies, LLC, Dearborn, MI (US)

(72) Inventors: Gopichandra Surnilla, West Bloomfield, MI (US); Mark Meinhart, South Lyon, MI (US); Joseph F. Basmaji, Waterford, MI (US); Ross Dykstra Pursifull, Dearborn, MI (US); Hao Zhang, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 507 days.

(21) Appl. No.: 14/099,615

(22) Filed: Dec. 6, 2013

(65) Prior Publication Data

US 2015/0159576 A1 Jun. 11, 2015

(51) Int. Cl.
*F02D 41/00* (2006.01)
*F02D 41/30* (2006.01)
(Continued)

(52) U.S. Cl.
CPC ..... *F02D 41/3082* (2013.01); *F02D 41/2464* (2013.01); *F02D 41/3845* (2013.01);
(Continued)

(58) Field of Classification Search
CPC ..... F02D 41/3082; F02D 41/2464; F02D 41/3845; F02D 2200/0602; F02D 2041/3881; F02M 63/0225; F02M 69/465
See application file for complete search history.

(56) References Cited

U.S. PATENT DOCUMENTS 5,230,613 A 7/1993 Hilsbos et al.
5,507,266 A 4/1996 Wright et al.
(Continued)

FOREIGN PATENT DOCUMENTS

CN 101231225 A 7/2008
EP 1355059 A2 10/2003
EP 2647824 A1 10/2013

OTHER PUBLICATIONS

Pursifull, Ross D. et al., "Direct Injection Pump Control for Low Fuel Pumping Volumes," U.S. Appl. No. 14/284,220, filed May 21, 2014, 40 pages.
(Continued)

*Primary Examiner* — Hieu T Vo
*Assistant Examiner* — Sherman Manley
(74) *Attorney, Agent, or Firm* — Julia Voutyras; John D. Russell; B. Anna McCoy

(57) ABSTRACT

Methods and systems are provided for closed loop operation of a high pressure fuel pump connected to the direct injectors of an internal combustion engine. During operation of the high pressure pump a dead zone may exist where a substantial change in the pump duty cycle does not correspond to a substantial change in the fuel rail pressure. To operate outside the dead zone, a relationship between the pump duty cycle and fuel rail pressure is learned upon completion of several pump and engine conditions, thereby improving high pressure pump operation and reducing pump degradation.

17 Claims, 7 Drawing Sheets

(51) Int. Cl.

| | |
|---|---|
| ***F02D 41/38*** | (2006.01) |
| ***F02D 41/24*** | (2006.01) |
| ***F02M 69/46*** | (2006.01) |
| ***F02M 63/02*** | (2006.01) |

(52) U.S. Cl.
CPC ..... *F02M 63/0225* (2013.01); *F02M 69/465* (2013.01); *F02D 2200/0602* (2013.01)

(56) References Cited

U.S. PATENT DOCUMENTS

| | | | |
|---|---|---|---|
| 5,598,817 | A | 2/1997 | Igarashi et al. |
| 5,715,797 | A | 2/1998 | Minagawa et al. |
| 5,755,211 | A | 5/1998 | Koch |
| 5,884,597 | A | 3/1999 | Hiraku et al. |
| 5,941,214 | A | 8/1999 | Hoffmann et al. |
| 6,209,525 | B1 | 4/2001 | Konishi et al. |
| 6,230,688 | B1 | 5/2001 | Faix et al. |
| 6,378,489 | B1 | 4/2002 | Stanglmaier et al. |
| 6,408,822 | B1 | 6/2002 | Rembold et al. |
| 6,422,203 | B1 | 7/2002 | Djordjevic |
| 6,439,202 | B1 | 8/2002 | Carroll, III et al. |
| 6,609,500 | B2 | 8/2003 | Ricco et al. |
| 6,694,950 | B2 | 2/2004 | Djordjevic |
| 6,725,837 | B2 | 4/2004 | Hiraku et al. |
| 6,739,317 | B2 | 5/2004 | Kellner et al. |
| 6,742,479 | B2 | 6/2004 | Yanagisawa |
| 6,748,923 | B2 | 6/2004 | Grossner et al. |
| 6,871,633 | B1 | 3/2005 | Date et al. |
| 6,953,025 | B2 | 10/2005 | Takahashi |
| 6,988,492 | B2 | 1/2006 | Shetley |
| 6,990,958 | B2 | 1/2006 | Asano et al. |
| 7,007,662 | B2 | 3/2006 | Sakai et al. |
| 7,013,872 | B2 | 3/2006 | Yamazaki et al. |
| 7,258,103 | B2 | 8/2007 | Tahara et al. |
| 7,347,186 | B2 | 3/2008 | Ricco et al. |
| 7,350,510 | B2 | 4/2008 | Tomatsuri et al. |
| 7,377,753 | B2 | 5/2008 | Kuroda |
| 7,584,747 | B1 | 9/2009 | Ibrahim et al. |
| 7,640,916 | B2 | 1/2010 | Ulrey et al. |
| 7,770,562 | B2 | 8/2010 | Pursifull et al. |
| 7,814,887 | B2 | 10/2010 | Cwielong et al. |
| 7,950,371 | B2 | 5/2011 | Cinpinski et al. |
| 8,220,322 | B2 | 7/2012 | Wang et al. |
| 8,342,151 | B2 | 1/2013 | Gwidt et al. |
| 8,590,510 | B2 | 11/2013 | Surnilla et al. |
| 2003/0029423 | A1 | 2/2003 | Boehland et al. |
| 2004/0154594 | A1* | 8/2004 | Miyashita ..... F02D 33/003 123/458 |
| 2005/0199219 | A1 | 9/2005 | Utsumi |
| 2008/0216797 | A1 | 9/2008 | Oono |
| 2008/0257304 | A1 | 10/2008 | Noda et al. |
| 2009/0090331 | A1* | 4/2009 | Pursifull ..... F02M 37/0058 123/446 |
| 2009/0159057 | A1 | 6/2009 | Pursifull et al. |
| 2010/0108035 | A1 | 5/2010 | Dusa et al. |
| 2011/0097228 | A1 | 4/2011 | Tokuo et al. |
| 2011/0162724 | A1 | 7/2011 | Kleckler |
| 2011/0208409 | A1 | 8/2011 | Snyder et al. |
| 2012/0048242 | A1* | 3/2012 | Surnilla ..... F02M 39/02 123/497 |
| 2012/0143475 | A1 | 6/2012 | Ryoo et al. |
| 2012/0167859 | A1* | 7/2012 | Basmaji ..... F02D 19/0605 123/456 |
| 2013/0213359 | A1 | 8/2013 | Zeng et al. |
| 2014/0305406 | A1* | 10/2014 | Pursifull ..... F02M 21/0239 123/434 |
| 2015/0275816 | A1* | 10/2015 | Pursifull ..... F02D 41/3094 123/456 |

OTHER PUBLICATIONS

Zhang, Hao et al., "Methods for Correcting Spill Valve Timing Error of a High Pressure Pump," U.S. Appl. No. 14/189,926, filed Feb. 25, 2014, 51 pages.

Pursifull, Ross D. et al., "Methods for Determining Fuel Bulk Modulus in a High-Pressure Pump," U.S. Appl. No. 14/189,946, filed Feb. 25, 2014, 52 pages.

Pursifull, Ross D. et al., "Direct Injection Fuel Pump," U.S. Appl. No. 14/198,082, filed Mar. 5, 2014, 67 pages.

Pursifull, Ross D. et al., "Rapid Zero Flow Lubrication Methods for a High Pressure Pump," U.S. Appl. No. 14/231,451, filed Mar. 31, 2014, 54 pages.

Ulrey, Joseph N. et al., "Adjustable Pump Volume Commands for Direct Injection Fuel Pumps," U.S. Appl. No. 14/300,162, filed Jun. 9, 2014, 42 pages.

Surnilla, Gopichandra et al., "Robust Direct Injection Fuel Pump System," U.S. Appl. No. 14/155,250, filed Jan. 14, 2014, 61 pages.

* cited by examiner

ADAPTIVE LEARNING OF DUTY CYCLE FOR A HIGH PRESSURE FUEL PUMP

FIELD

The present application relates to implementation of zero flow lubrication for a high pressure fuel pump in an internal combustion engine.

SUMMARY/BACKGROUND

Some vehicle engine systems utilize both direct in-cylinder fuel injection and port fuel injection. The fuel delivery system may include multiple fuel pumps for providing fuel pressure to the fuel injectors. As one example, a fuel delivery system may include a lower pressure fuel pump (or lift pump) and a higher pressure fuel pump arranged between the fuel tank and fuel injectors. The high pressure fuel pump may be coupled to the direct injection system, upstream of a fuel rail to raise a pressure of the fuel delivered to the engine cylinders through the direct injectors. However, when the high pressure fuel pump is turned off, such as when no direct injection of fuel is requested, pump durability may be affected, as the pump may be mechanically driven by the engine crank or camshaft. Specifically, the lubrication and cooling of the pump may be reduced while the high pressure pump is not operated, thereby leading to pump degradation.

In one approach to reduce high pressure pump degradation, shown by Basmaji et al. in US 2012/0167859, the low pressure fuel pump and higher pressure fuel pump are operated depending upon engine conditions. For example, when direct injection is not needed and high pressure pump operation is not requested, the lower pressure pump is operated to maintain a fuel rail pressure in the fuel rail while supplying fuel to the engine through port injection. Operation of the higher pressure pump is then adjusted to maintain a high enough pump chamber pressure so that fuel is pushed through the piston-bore interface, thereby lubricating the pump. In this way, the approach of Basmaji provides zero flow lubrication of the pump. In addition to lubricating the higher pressure pump during zero flow conditions, the pump NVH characteristics are improved.

However the inventors herein have identified potential issues with the approach of US 2012/0167859. Zero flow lubrication may be limited in a dead zone of the high pressure fuel pump, the dead zone being a region of pump operation where a substantial change in the duty cycle of the pump does not lead to a substantial corresponding change in fuel rail pressure. Graphically, this range appears as a horizontal, or effectively horizontal, line between fuel rail pressure and pump duty cycle. It is noted that pump duty cycle refers to controlling the closing of the pump spill valve. For example, if the spill valve closes coincident with the beginning of the engine compression stroke, the event is referred to as a 100% duty cycle. If the spill valve closes 95% into the compression stroke, the event is referred to as a 5% duty cycle. While commanding a 5% duty cycle, in effect 95% of the displaced volume is spilled and the remaining 5% is compressed during the stroke.

While operating a high pressure pump in closed loop control within the dead zone, large amplitude limit cycling may occur. As fuel rail pressure decreases, the pump duty cycle increases but it has no substantial effect until it climbs above a threshold value (e.g. the end of the dead zone). The limit cycling occurs as a result of the delay in fuel rail pressure change during closed loop rail pressure control. In one example, during positive flow operation the target fuel rail pressure may decrease abruptly, causing the high pressure pump pumping rate to also decrease while in closed loop control. The reduction in pumping rate may cause the pump to operate in the dead zone. Without prior calculation of the dead zone, the feedback fuel rail pressure controller causes the aforementioned limit cycling. Operating in the pump dead zone wastes pump energy and reduces pump volumetric efficiency.

Thus in one example, the above issues may be addressed by a method for an engine fuel system comprising: decreasing fuel rail pressure below a threshold; then, while not direct injecting fuel into an engine, learning a dead zone for a high pressure fuel pump based on a change in pump duty cycle relative to a resulting change in fuel rail pressure; and while direct injecting fuel into the engine, adjusting the pump duty cycle to stay above the learned dead zone. In this way, fuel pump lubrication can be improved, even when operating in the dead zone.

For example, in an engine system that is fueled via both port and direct injection, a high pressure pump may be used for increasing fuel pressure in a rail connected to the direct injectors. In the same system, a low pressure pump may be connected upstream of the high pressure pump and provides pressure to the port injectors on a different rail in addition to providing fuel to the high pressure pump inlet. First, the fuel rail pressure is decreased to a low value by ceasing to pump and continuing to direct inject. Then, while not direct injecting fuel into the engine, such as when only port injecting fuel to the engine, the duty cycle of the high pressure pump may be incrementally changed in small amounts (e.g. 1%, 2%, 3%) and a resulting fuel rail pressure may be recorded. Once the fuel rail pressure increases based on the increase in duty cycle, then operation outside the dead zone is reached and the relationship between duty cycle and rail pressure can be learned. As an upper limit, the duty cycles stops incrementing when the rail pressure reaches a threshold, such as the fuel rail pressure relief valve setting. Based on the change in fuel rail pressure, a dead zone of the pump may be identified and a duty cycle transfer function may be adaptively updated. The transfer function may then be applied when direct injecting fuel into the engine to provide a duty cycle that allows pump operation outside the dead zone. In one example, the controller integral term would be limited such that the commanded duty cycle would not be less than the zero flow lubrication duty cycle corresponding to a particular fuel rail pressure. In effect, this involves commanding a minimum duty cycle that is always above and outside the adaptively learned dead zone.

In this way, by learning the relationship between duty cycle and rail pressure for a high pressure fuel pump, a dead zone of the pump may be accurately quantified so that the pump command can be adjusted in the dead zone. For example, the pump may be commanded to not operate in the dead zone. Alternatively, the pump may be commanded to operate at a fixed (e.g., minimum) duty cycle in the dead zone. By reducing pump operation in the dead zone, the time for pump response to rail pressure changes is improved, reducing pump limit cycling, particularly when operating the pump with closed-loop control. By allowing for improved zero flow lubrication, pump operation may be optimized to reduce degradation and increase the longevity of the high pressure pump. Overall, high pressure pump operation is improved.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

BRIEF DESCRIPTION OF THE DRAWINGS

The context and subject matter of the present disclosure will be better understood by reading the following detailed description of implementation of the duty cycle learning process. Furthermore, non-limiting embodiments of the engine and fuel systems are provided to allow for better understanding of the duty cycle/fuel rail pressure relationship.

DETAILED DESCRIPTION

Figure 2:
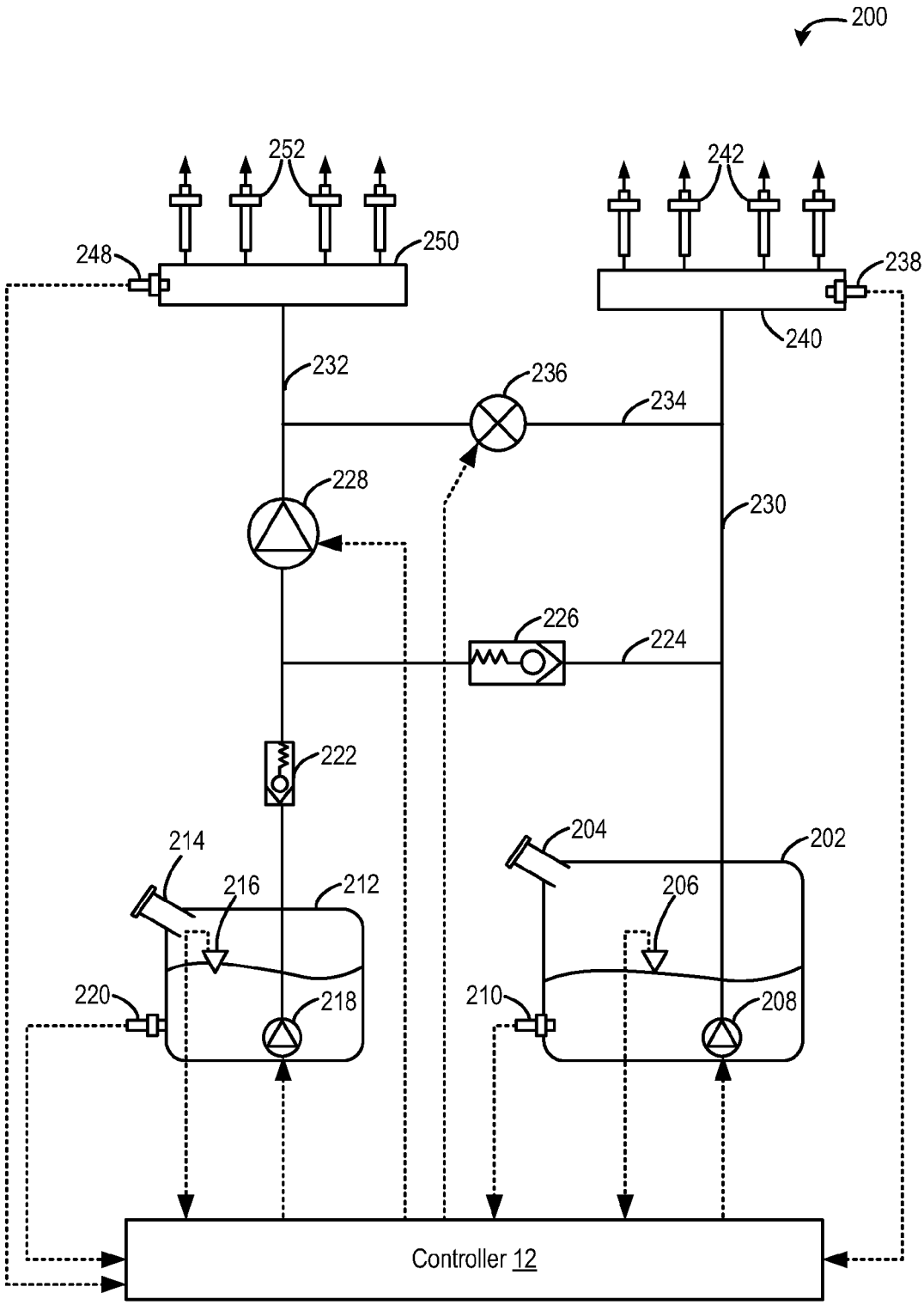
FIG. 2 schematically depicts an example embodiment of a fuel system that may be used with the engine of FIG. 1.
Figure 3:
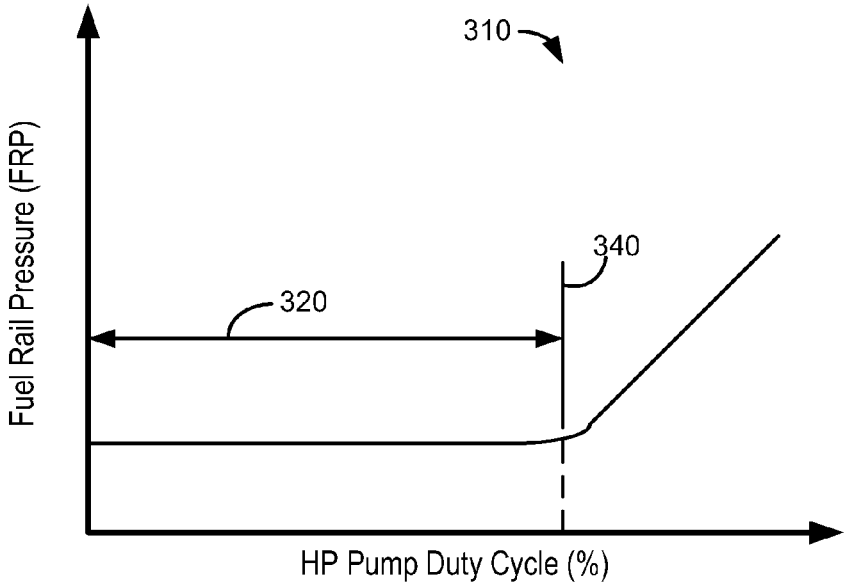
FIG. 3 depicts operation of a high pressure fuel pump in a dead zone of the pump.
Figure 3:
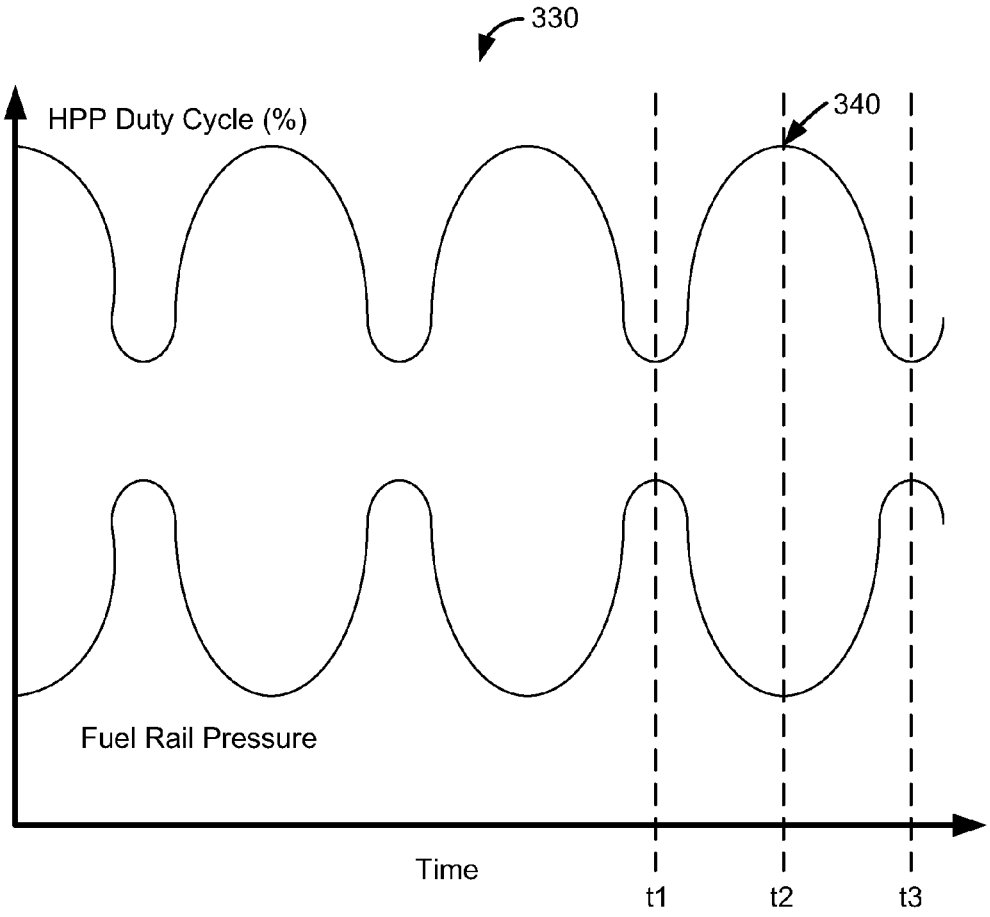
Figure 4:
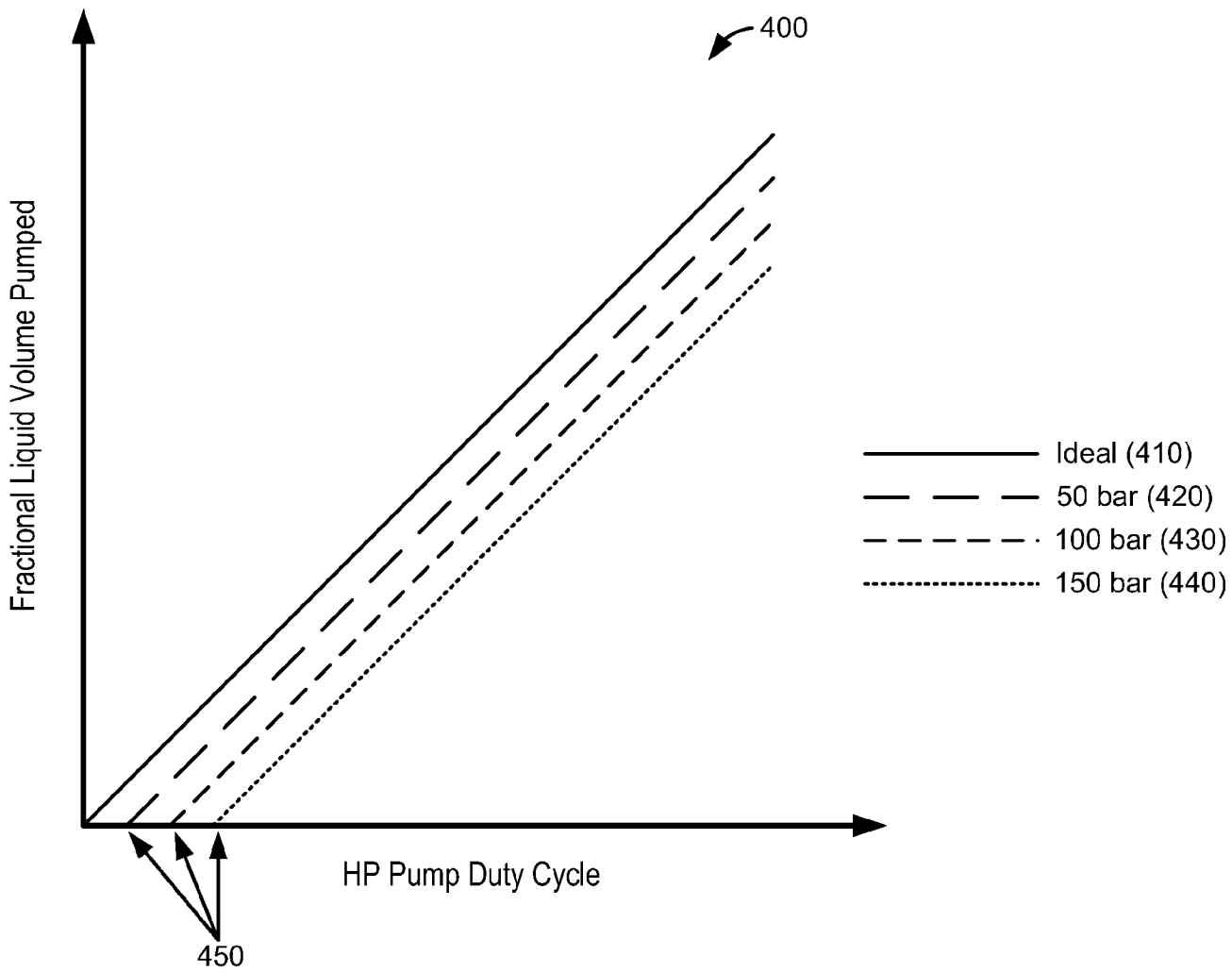
FIG. 4 depicts the graphical relationship between high pressure pump duty cycle and fractional liquid volume pumped.
Figure 5:
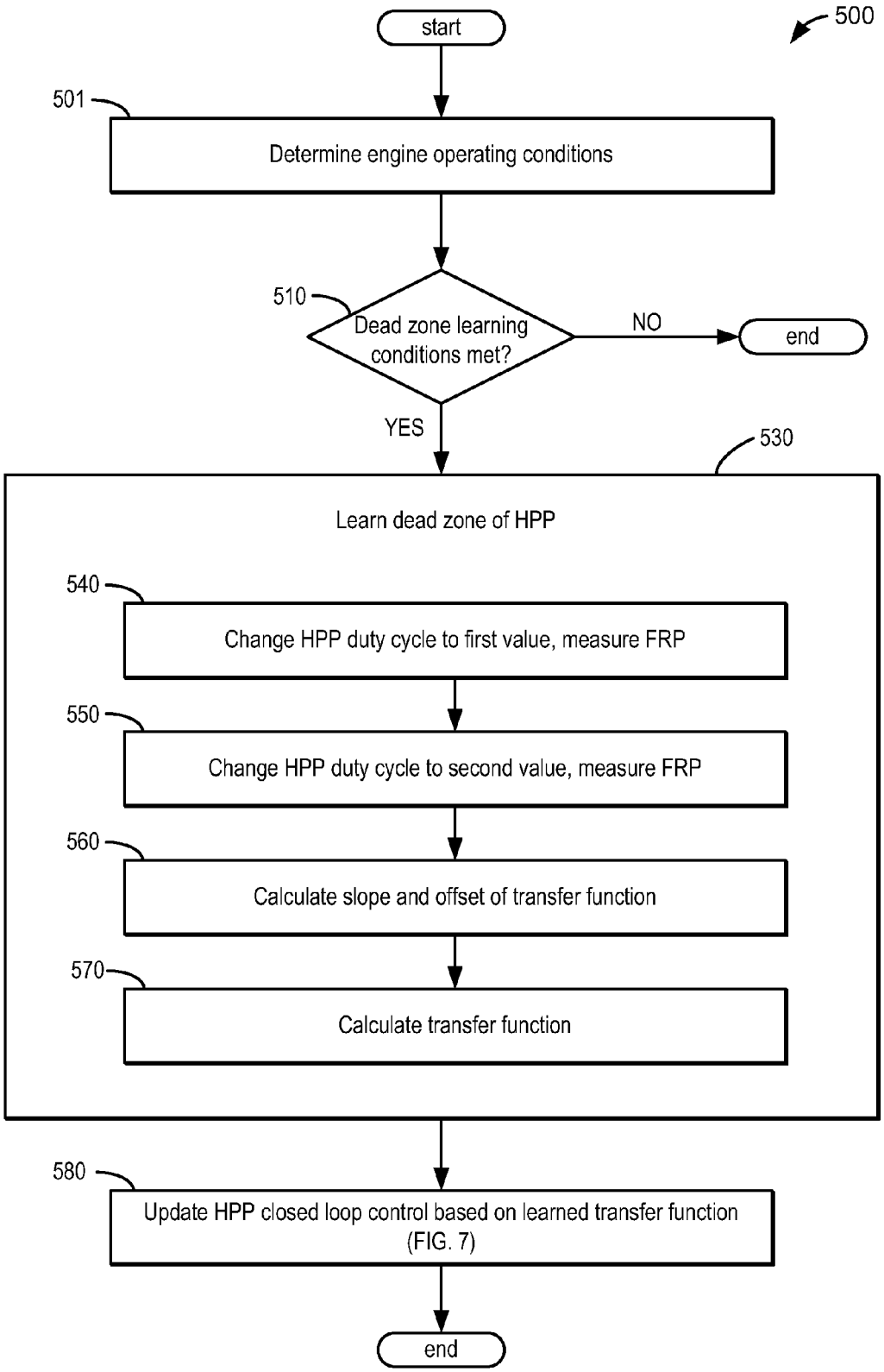
FIG. 5 shows a flow chart for adaptively learning a relationship between pump duty cycle and fuel rail pressure for a high pressure fuel pump, including learning a dead zone of the pump.
Figure 6:
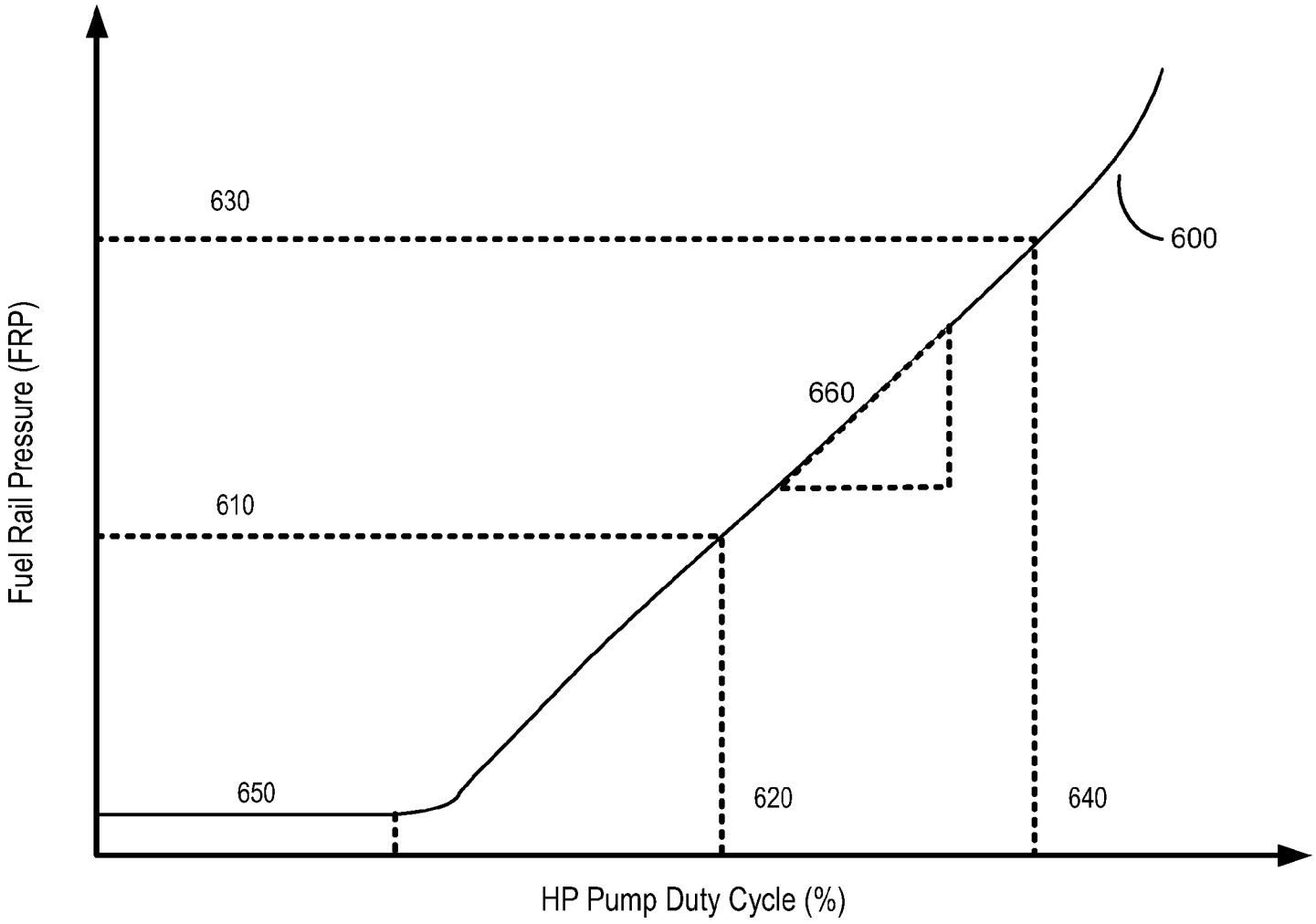
FIG. 6 shows the adaptive learning of FIG. 5 in a graphical form.

The present disclosure provides a method to determine an accurate relationship among duty cycle, flow rate, and fuel rail pressure. In particular, the relationship between duty cycle and fuel rail pressure during zero flow rate of the direct injectors is described herein. The method is implemented in a fuel system, such as the system of FIG. 2, configured to deliver one or more different fuel types to a combustion engine, such as the engine of FIG. 1. As shown in FIG. 2, the fuel system may include a first group of port injectors configured to port inject a selected fuel, and a second group of direct injectors configured to direct inject a selected fuel. While operating the second or high pressure pump during closed-loop control within the dead zone, severe limit cycling may occur as shown in FIG. 3. Furthermore, operation within the dead zone affects the concept of volumetric efficiency of the high pressure pump (FIG. 4). To determine the relationship between pump duty cycle and fuel rail pressure, a learning method is performed during engine operation, as seen in FIG. 5. The adaptive learning is also represented in a graphical form (FIG. 6). Once the relationship, or transfer function, is learned the high pressure pump can be operated in closed loop control during zero flow lubrication according to a general flow chart, seen in FIG. 7. In this way, the pump can be operated outside the dead zone to reduce limit cycling.

Regarding terminology in the following disclosure, a high pressure pump that is connected to the direct injectors may also be referred to as the HP pump or simply HPP. Similarly, the low pressure pump may also be referred to as the LP pump or simply LPP. The aforementioned relationship between the high pressure pump duty cycle and direct injector fuel rail pressure (FRP) is also known as the transfer function.

First, a description is given regarding lubricating the high pressure pump. The following descriptions relate to methods and systems for operating a fuel system, such as the system of FIG. 2, configured to deliver one or more different fuel types to a combustion engine, such as the engine of FIG. 1. As shown in FIG. 2, the fuel system may include a first group of port injectors configured to port inject a selected fuel, and a second group of direct injectors configured to direct inject a selected fuel. A high pressure pump may be provided downstream of a low pressure pump for raising a pressure of the fuel to be direct injected. As such, during direct injection of fuel, the high pressure pump may be sufficiently lubricated. However, during conditions when high pressure pump operation is not requested, an engine controller may maintain lubrication and/or cooling of the high pressure fuel pump by operating the low pressure pump to maintain a fuel rail pressure while adjusting a stroke amount of the high pressure pump to maintain a peak pump chamber pressure of the high pressure pump just below the fuel rail pressure. This type of operation is referred to as zero flow lubrication. The controller may be configured to perform one or more routines, to maintain the peak pump chamber pressure of the high pressure pump just below the fuel rail pressure, and intermittently increment the HP pump duty cycle to monitor for corresponding changes in fuel rail pressure. In this way, by maintaining the peak pump chamber pressure just below the fuel rail pressure, without flowing fuel into the fuel rail, the pump may be maintained sufficiently lubricated even when high pressure pump operation is not requested. However, during zero flow lubrication the pump may be operated in a region known as the dead zone, where a change in high pressure pump duty cycle does not correspond to a change in fuel rail pressure. As such, a scheme needs to be devised to learn the dead zone and operate the pump accordingly. As such, this improves pump reliability and reduces degradation of the high pressure pump.

Figure 1:
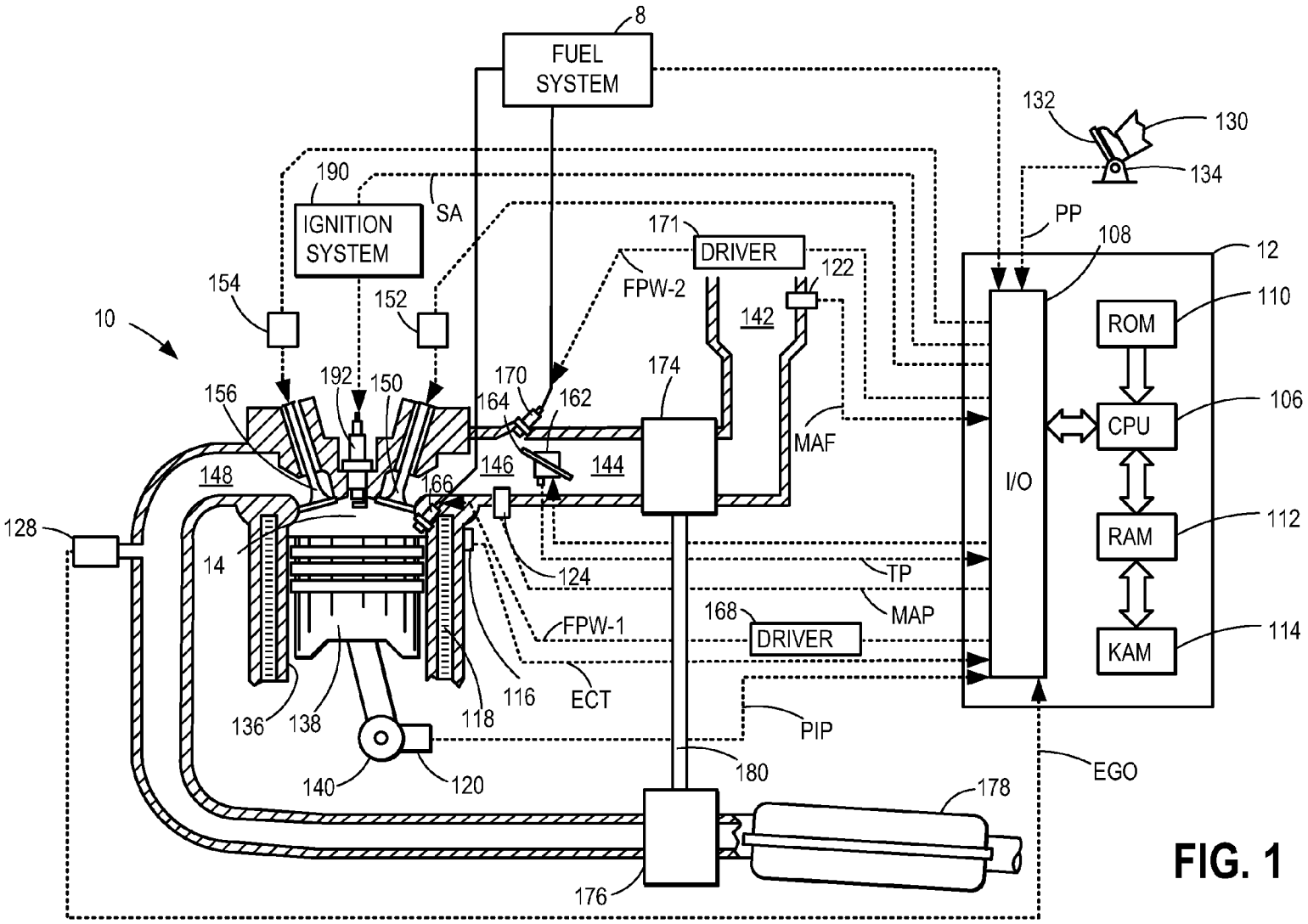
FIG. 1 schematically depicts an example embodiment of a cylinder of an internal combustion engine.

FIG. 1 depicts an example embodiment of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be disposed downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIG. 2, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Alternatively, fuel may be delivered by a single stage fuel pump at lower pressure, in which case the timing of the direct fuel injection may be more limited during the compression stroke than if a high pressure fuel system is used. Further, the fuel tank may have a pressure transducer providing a signal to controller 12. An example embodiment of fuel system 8 is further elaborated herein with reference to FIG. 2.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

FIG. 2 schematically depicts an example embodiment 200 of the fuel system of FIG. 1. Fuel system 200 may be operated to deliver fuel to an engine, such as engine 10 of FIG. 1. Fuel system 200 may be operated by a controller to perform some or all of the operations described with reference to the process flow of FIGS. 5 and 7.

Fuel system 200 can provide fuel to an engine from one or more different fuel sources. As a non-limiting example, a first fuel tank 202 and a second fuel tank 212 may be provided. While fuel tanks 202 and 212 are described in the context of discrete vessels for storing fuel, it should be appreciated that these fuel tanks may instead be configured as a single fuel tank having separate fuel storage regions that are separated by a wall or other suitable membrane. Further still, in some embodiments, this membrane may be configured to selectively transfer select components of a fuel between the two or more fuel storage regions, thereby enabling a fuel mixture to be at least partially separated by the membrane into a first fuel type at the first fuel storage region and a second fuel type at the second fuel storage region.

In some examples, first fuel tank 202 may store fuel of a first fuel type while second fuel tank 212 may store fuel of a second fuel type, wherein the first and second fuel types are of differing composition. As a non-limiting example, the second fuel type contained in second fuel tank 212 may include a higher concentration of one or more components that provide the second fuel type with a greater relative knock suppressant capability than the first fuel.

By way of example, the first fuel and the second fuel may each include one or more hydrocarbon components, but the second fuel may also include a higher concentration of an alcohol component than the first fuel. Under some conditions, this alcohol component can provide knock suppression to the engine when delivered in a suitable amount relative to the first fuel, and may include any suitable alcohol such as ethanol, methanol, etc. Since alcohol can provide greater knock suppression than some hydrocarbon based fuels, such as gasoline and diesel, due to the increased latent heat of vaporization and charge cooling capacity of the alcohol, a fuel containing a higher concentration of an alcohol component can be selectively used to provide increased resistance to engine knock during select operating conditions.

As another example, the alcohol (e.g. methanol, ethanol) may have water added to it. As such, water reduces the alcohol fuel's flammability giving an increased flexibility in storing the fuel. Additionally, the water content's heat of vaporization enhances the ability of the alcohol fuel to act as a knock suppressant. Further still, the water content can reduce the fuel's overall cost.

As a specific non-limiting example, the first fuel type in the first fuel tank may include gasoline and the second fuel type in the second fuel tank may include ethanol. As another non-limiting example, the first fuel type may include gasoline and the second fuel type may include a mixture of gasoline and ethanol. In still other examples, the first fuel type and the second fuel type may each include gasoline and ethanol, whereby the second fuel type includes a higher concentration of the ethanol component than the first fuel (e.g., E10 as the first fuel type and E85 as the second fuel type). As yet another example, the second fuel type may have a relatively higher octane rating than the first fuel type, thereby making the second fuel a more effective knock suppressant than the first fuel. It should be appreciated that these examples should be considered non-limiting as other suitable fuels may be used that have relatively different knock suppression characteristics. In still other examples, each of the first and second fuel tanks may store the same fuel. While the depicted example illustrates two fuel tanks with two different fuel types, it will be appreciated that in alternate embodiments, only a single fuel tank with a single type of fuel may be present.

Fuel tanks 202 and 212 may differ in their fuel storage capacities. In the depicted example, where second fuel tank 212 stores a fuel with a higher knock suppressant capability, second fuel tank 212 may have a smaller fuel storage capacity than first fuel tank 202. However, it should be appreciated that in alternate embodiments, fuel tanks 202 and 212 may have the same fuel storage capacity.

Fuel may be provided to fuel tanks 202 and 212 via respective fuel filling passages 204 and 214. In one example, where the fuel tanks store different fuel types, fuel filling passages 204 and 214 may include fuel identification markings for identifying the type of fuel that is to be provided to the corresponding fuel tank.

A first low pressure fuel pump (LPP) 208 in communication with first fuel tank 202 may be operated to supply the first type of fuel from the first fuel tank 202 to a first group of port injectors 242, via a first fuel passage 230. In one example, first fuel pump 208 may be an electrically-powered lower pressure fuel pump disposed at least partially within first fuel tank 202. Fuel lifted by first fuel pump 208 may be supplied at a lower pressure into a first fuel rail 240 coupled to one or more fuel injectors of first group of port injectors 242 (herein also referred to as first injector group). While first fuel rail 240 is shown dispensing fuel to four fuel injectors of first injector group 242, it will be appreciated that first fuel rail 240 may dispense fuel to any suitable number of fuel injectors. As one example, first fuel rail 240 may dispense fuel to one fuel injector of first injector group 242 for each cylinder of the engine. Note that in other examples, first fuel passage 230 may provide fuel to the fuel injectors of first injector group 242 via two or more fuel rails. For example, where the engine cylinders are configured in a V-type configuration, two fuel rails may be used to distribute fuel from the first fuel passage to each of the fuel injectors of the first injector group.

First fuel pump 208 may be coupled upstream of a second high pressure fuel pump (HPP) 228 that is included in second fuel passage 232. In one example, second fuel pump 228 may be a mechanically-powered positive-displacement pump. Second fuel pump 228 may be in communication with a group of direct injectors 252 via a second fuel rail 250, and the group of port injectors 242 via a solenoid valve 236. Thus, lower pressure fuel lifted by first fuel pump 208 may be further pressurized by second fuel pump 228 so as to supply higher pressure fuel for direct injection to second fuel rail 250 coupled to one or more fuel injectors of second group of injectors 252 (herein also referred to as second injector group). In some embodiments, a fuel filter (not shown) may be disposed upstream of second fuel pump 228 to remove particulates from the fuel. Further, in some embodiments a fuel pressure accumulator (not shown) may be coupled downstream of the fuel filter, between the low pressure pump and the high pressure pump.

A third low pressure fuel pump 218 in communication with second fuel tank 212 may be operated to supply the second type of fuel from the second fuel tank 202 to the second group of direct injectors 252, via the second fuel passage 232. In this way, second fuel passage 232 fluidly couples each of the first fuel tank and the second fuel tank to the group of direct injectors. In one example, third fuel pump 218 may also be an electrically-powered low pressure fuel pump (LPP), disposed at least partially within second fuel tank 212. Thus, lower pressure fuel lifted by third fuel pump 218 may be further pressurized by higher pressure fuel pump 228 so as to supply higher pressure fuel for direct injection to second fuel rail 250 coupled to one or more fuel injectors of second group of injectors 252. In one embodiment, third fuel pump 218 and second fuel pump 228 can be operated to provide the second fuel type at a higher fuel pressure to second fuel rail 250 than the fuel pressure of the first fuel type that is provided to first fuel rail 240 by first fuel pump 208.

Fluid communication between first fuel passage 230 and second fuel passage 232 may be achieved through first and second bypass passages 224 and 234. Specifically, first bypass passage 224 may couple first fuel passage 230 to second fuel passage 232 upstream of second fuel pump 228, while second bypass passage 234 may couple first fuel passage 230 to second fuel passage 232 downstream of second fuel pump 228. One or more pressure relief valves may be included in the fuel passages and/or bypass passages to resist or inhibit fuel flow back into the fuel storage tanks. For example, a first pressure relief valve 226 may be provided in first bypass passage 224 to reduce or prevent back flow of fuel from second fuel passage 232 to first fuel passage 230 and first fuel tank 202. A second pressure relief valve 222 may be provided in second fuel passage 232 to reduce or prevent back flow of fuel from the first or second fuel passages into second fuel tank 212. In one example, lower pressure pumps 208 and 218 may have pressure relief valves integrated into the pumps. The integrated pressure relief valves may limit the pressure in the respective lift pump fuel lines. For example, a pressure relief valve integrated in first fuel pump 208 may limit the pressure that would otherwise be generated in first fuel rail 240 if solenoid valve 236 were (intentionally or unintentionally) open and while high pressure pump 228 were pumping.

In some embodiments, the first and/or second bypass passages may also be used to transfer fuel between fuel tanks 202 and 212. Fuel transfer may be facilitated by the inclusion of additional check valves, pressure relief valves, solenoid valves, and/or pumps in the first or second bypass passage, for example, solenoid valve 236. In still other embodiments, one of the fuel storage tanks may be arranged at a higher elevation than the other fuel storage tank, whereby fuel may be transferred from the higher fuel storage tank to the lower fuel storage tank via one or more of the bypass passages. In this way, fuel may be transferred between fuel storage tanks by gravity without necessarily requiring a fuel pump to facilitate the fuel transfer.

The various components of fuel system 200 communicate with an engine control system, such as controller 12. For example, controller 12 may receive an indication of operating conditions from various sensors associated with fuel system 200 in addition to the sensors previously described with reference to FIG. 1. The various inputs may include, for example, an indication of an amount of fuel stored in each of fuel storage tanks 202 and 212 via fuel level sensors 206 and 216, respectively. Controller 12 may also receive an indication of fuel composition from one or more fuel composition sensors, in addition to, or as an alternative to, an indication of a fuel composition that is inferred from an exhaust gas sensor (such as sensor 126 of FIG. 1). For example, an indication of fuel composition of fuel stored in fuel storage tanks 202 and 212 may be provided by fuel composition sensors 210 and 220, respectively. Additionally or alternatively, one or more fuel composition sensors may be provided at any suitable location along the fuel passages between the fuel storage tanks and their respective fuel injector groups. For example, fuel composition sensor 238 may be provided at first fuel rail 240 or along first fuel passage 230, and/or fuel composition sensor 248 may be provided at second fuel rail 250 or along second fuel passage 232. As a non-limiting example, the fuel composition sensors can provide controller 12 with an indication of a concentration of a knock suppressing component contained in the fuel or an indication of an octane rating of the fuel. For example, one or more of the fuel composition sensors may provide an indication of an alcohol content of the fuel.

Note that the relative location of the fuel composition sensors within the fuel delivery system can provide different advantages. For example, sensors 238 and 248, arranged at the fuel rails or along the fuel passages coupling the fuel injectors with one or more fuel storage tanks, can provide an indication of a resulting fuel composition where two or more different fuels are combined before being delivered to the engine. In contrast, sensors 210 and 220 may provide an indication of the fuel composition at the fuel storage tanks, which may differ from the composition of the fuel actually delivered to the engine.

Controller 12 can also control the operation of each of fuel pumps 208, 218, and 228 to adjust an amount, pressure, flow rate, etc., of a fuel delivered to the engine. As one example, controller 12 can vary a pressure setting, a pump stroke amount, a pump duty cycle command, and/or fuel flow rate of the fuel pumps to deliver fuel to different locations of the fuel system. A driver (not shown) electronically coupled to controller 12 may be used to send a control signal to each of the low pressure pumps, as required, to adjust the output (e.g. speed) of the respective low pressure pump. The amount of first or second fuel type that is delivered to the group of direct injectors via the high pressure pump may be adjusted by adjusting and coordinating the output of the first or third LPP and the HPP. For example, the lower pressure fuel pump and the higher pressure fuel pump may be operated to maintain a prescribed fuel rail pressure. A fuel rail pressure sensor coupled to the second fuel rail may be configured to provide an estimate of the fuel pressure available at the group of direct injectors. Then, based on a difference between the estimated rail pressure and a desired rail pressure, the pump outputs may be adjusted. In one example, where the high pressure fuel pump is a volumetric displacement fuel pump, the controller may adjust a flow control valve of the high pressure pump to vary the effective pump volume of each pump stroke.

As such, while the higher pressure pump is operating, flow of fuel there-though ensures sufficient pump lubrication and cooling. However, during conditions when higher pressure pump operation is not requested, such as when no direct injection of fuel is requested, when only port injection of fuel is requested, and/or when the fuel level in the second fuel tank 212 is below a threshold, the higher pressure pump may not be sufficiently lubricated if pump operation is discontinued.

The inventors herein have recognized that for the implementation of the zero flow lubrication of the higher pressure pump, a learned relationship between the pump duty cycle and fuel rail pressure can be used to advantage to improve operation. The relationship is a function of the fuel type and pump cam lift versus engine rotation, parameters which vary depending on the engine system. If a fixed calibration is used, the correct duty cycle may not be provided for sufficient lubrication of the high pressure pump. For example, if the scheduled duty cycle is lower than desired for a given fuel rail pressure, the pump chamber pressure will also be lower than desired, causing lower lubrication to the high pressure pump. This would lead to the aforementioned core problem of pump degradation. Due to variability between engine systems, a method is needed to learn the transfer function onboard the vehicle.

One approach is to learn the relationship by changing the high pressure pump duty cycle and monitoring the rail pressure to determine the steady state fuel rail pressure. For a given vehicle system, a transfer function is learnt that allows for adequate lubrication of the high pressure pump. Once the relationship between duty cycle and rail pressure is learned (i.e. the transfer function) for a particular engine system, the relationship can be used to modify pump operation during closed loop control. Closed loop control involves a feedback of rail pressure measurements so incremental adjustments to the pump duty cycle can be made to ensure proper pump lubrication while not drastically affecting the fuel rail pressure. At low duty cycle of higher pressure fuel pump operation, a region exists known as the dead zone where changes in the duty cycle have little to no effect on the fuel rail pressure. The dead zone and learning process are described below, beginning with FIG. 3.

FIG. 3 depicts the dead zone region 320 of high pressure pump operation, where an actual change in fuel rail pressure responsive to a change in pump duty cycle is lower than the expected change in fuel rail pressure. The first graph 310 shows the relationship between HP pump control duty cycle and the fuel rail pressure. Note that from the deactivated pump (0% duty cycle) to a duty cycle threshold value 340 the fuel rail pressure does not change. This region is the dead zone 320. If one were to operate the HP pump during a closed loop control, the result is shown in the second graph 330.

The second graph 330 shows HP pump closed loop control and severe limit cycling caused in the dead zone. The limit cycling refers to the large amplitude oscillations of both the fuel rail pressure and HP pump duty cycle plots. The dead zone affects pump operation in the following manner: at time t1 the fuel rail pressure starts decreasing. The decrease in rail pressure causes the high pressure pump to increase its duty cycle in order to restore the desired fuel rail pressure. However, as seen in the first graph 310, the first several percent of the HP pump duty cycle has little to no effect on the fuel rail pressure. Consequently, the fuel rail pressure continues to decrease on the second graph 330 as the duty cycle increases, until the duty cycle increases above a threshold value 340 at time t2. After t2, the fuel rail pressure increases as the pump duty cycle increases, as shown in both 310 and 330. When the fuel rail pressure reaches a desired value the high pressure pump stops and the process repeats at time t3 when the rail pressure begins to decrease again. The delay in the pump response causes the limit cycling which is manifested as the severe oscillations in the graph 330.

The dead zone also has an impact on the volumetric efficiency of the high pressure pump. The volumetric efficiency is a measure of how much liquid volume is pumped compared to the pump duty cycle. FIG. 4 depicts a graph showing the relationship between the HP pump duty cycle and fractional liquid volume pumped 400. The plots of FIG. 4 represent testing of a single fluid with a given bulk modulus at different fuel rail pressures. The points 450 at which the three data lines cross the x-axis are the zero flow rate data. It is noted that the data 450 is plotted in FIG. 3 as 310 and in FIG. 6 as 600. Ideally, for each unit duty cycle increase in FIG. 4, the fractional liquid volume pumped also increases by one unit, as seen in the ideal plot 410. In reality, this is not the case due to imperfect valving and finite bulk modulus of the pumped liquid. Commonly, the realistic relationship is modeled as beginning from the origin and extending linearly to a value below the ideal volume pumped. However, if the dead zone 320 of FIG. 3 is taken into consideration, the relationship starts at a positive duty cycle value when the pumped volume is 0 and increases linearly, as seen in the other three plots (420, 430, 440). Graphically, this means that the x-intercepts for the real plots are positive values, where the x-intercept depends upon the fuel rail pressure.

The graph 400 shows three realistic pump plots corresponding to pressures of 50 bar, 100 bar, and 150 bar. Due to this discrepancy between the common notion of volumetric efficiency and reality, one would not be able to use volumetric efficiency as a feedback to improve high pressure pump operation if the common model was used. The reason is that there are two factors that contribute to pumping a smaller liquid volume than anticipated. The first factor is insufficient lift pump pressure to provide fuel to the high pressure pump. The second factor is operating the high pressure pump in the dead zone, wherein the pump duty cycle is below a certain value so no fluid is pumped into the fuel rail, thereby causing no increase in the fuel rail pressure. The first factor is expected and the second is due to the dead zone. Schemes for controlling pump operation cannot involve the use of volumetric efficiency unless the second factor is addressed. The present disclosure addresses this issue.

To reduce the limit cycling of the high pressure fuel pump during closed loop control, as shown in FIG. 3, the inventors herein have developed an approach to reduce pump operation in the dead zone. In particular, by adaptively learning the dead zone of the HP pump, a pump duty cycle may be commanded taking the dead zone into consideration. In one example, the adjusted pump duty cycle results in not commanding a duty cycle in the dead zone while in closed loop FRP control. FIG. 5 shows an example method 500 for learning the dead zone of a high pressure pump. The method shown may be executed by a controller 12. Presented below is an example process of learning the HPP dead zone. It is understood that the following is a non-limiting embodiment of the present disclosure, given for exemplary purposes and for proper understanding of the learning process.

Prior to learning the dead zone, several engine operating conditions are estimated and/or measured at 501. These include, for example, engine speed, torque demand, engine temperature, barometric pressure, fuel level in the fuel tank, etc.

At 510, based on the estimated engine operating conditions, it may be determined if dead zone learning conditions are present. In one example engine system, where fuel is injected via both port and direct injectors as described previously, dead zone conditions may be considered met if the engine is operating with no direct fuel injection and with the fuel rail pressure below a threshold. For example, the engine may be in an idling state and may be run with only direct injection to bring the rail pressure to a lower threshold. Next, while operating the engine at or below the lower rail pressure threshold, the engine may be fueled by the port injectors only. While the engine is operating in port injection mode and not direct injecting fuel, the rail pressure in the HP fuel rail may be held constant. In one example, as shown with reference to FIG. 6, direct injection may be used to reduce the fuel rail pressure to a lower threshold rail pressure 650.

In another example, where the engine system is configured for only direct injection of fuel, dead zone learning conditions may be considered met if the engine is in a shut-off condition or a deceleration fuel shut-off condition where no direct injection is being performed so as to bring the rail pressure to the lower threshold. If dead zone learning conditions are confirmed, dead zone learning can be initiated at 530. If dead zone learning conditions 501 are not met, the learning command is not activated by the controller 12 and the engine continues its nominal operation.

Dead zone learning (at 530) includes, at 540, commanding a first duty cycle of the high pressure pump. When the first duty cycle is provided to the pump, the pressure in the rail rises since the rail pressure is initially lower than the pressure in the HP pump chamber. The rail pressure will rise until the HP pump chamber pressure equals the rail pressure, signifying the rail pressure has achieved the steady-state HP pump chamber pressure for the first HP pump duty cycle value. The first fuel rail pressure is then determined (e.g., estimated). It is noted here that the fuel rail pressure is generally slightly lower than the HP pump compression chamber peak pressure (about 0.7 bar lower) due to the pressure drop across the pump outlet check valve.

Next, at step 550, a second, higher duty cycle is commanded and the same process is repeated. Once the rail pressure equals the HP pump chamber pressure, the rail pressure has reached a second steady-state value and is determined. In one example, the first duty cycle command is 4% and the second duty cycle commanded is 6%. Next, with the required data the relationship between HP pump duty cycle and FRP can be calculated. The step 560 involves calculating the slope and offset of the transfer function. The known equation of a line method is used, where the slope can be found by dividing the difference between the first and second fuel rail pressures by the difference between the first and second commanded duty cycles. The offset, or x-axis intercept, is calculated by using the found slope, first fuel rail pressure, and first duty cycle.

In the final step 570, the affine relationship between the HP pump duty cycle and fuel rail pressure, also referred to as the transfer function, can be explicitly written in the form of an equation of a line using the slope and offset, as described later. With the calculated transfer function that defines the dead zone of the HPP, the HPP closed loop operation can be updated 580 so as to operate the pump outside the dead zone. It is noted that the dead zone 320 occurs when the duty cycle is incrementing while the FRP is already greater than zero pressure. If the learning routine 530 is started at zero pressure, a curve similar to the realistic curves in FIG. 4 (420, 430, 440) will be created.

In addition to learning the dead zone, the method can also be used to calculate the actual volume pumped by the high pressure fuel pump. For example, the fraction volume pumped (FVP) may be estimated as:

FVP=(max(DC,XDC)−XDC)*(VE/(1-XDC)), wherein DC=HP pump duty cycle, XDC=The x-intercept, and VE=Volumetric efficiency at a duty cycle of one. With reference to FIG. 4, the volumetric efficiency relates to how much liquid volume is pumped in reality compared to the ideal amount 410. Where the ideal line passes through the origin of graph 400, the real lines pass through the x-axis where the x-intercept is a positive HP pump duty cycle value. Then, the duty cycle to command can be calculated as DC=(1-XDC)/VE*FVP+XDC, since the x-intercept is a function of the fuel rail pressure.

FIG. 6 shows a graphic representation 600 of the learning method of FIG. 5., wherein a zero flow rate condition is commanded, then the pump duty cycle is incremented while recording the resulting FRP. Map 600 depicts the relationship between HP pump duty cycle (along the x-axis) and fuel rail pressure (along the y-axis). The markers represent the points at which data is measured (610, 620, 630, 640, 650). The aforementioned lower rail pressure threshold can be seen plotted in the graph (650). The first commanded duty cycle of the pump 620 corresponds to a responsive fuel rail pressure 610. Once the data is determined (e.g., estimated), the pump duty cycle increases to a second, higher value 640. The increments may be small, such as 1%, 2%, or 3%. Again, once the rail pressure has reached a steady-state value 630 corresponding to the second pump duty cycle 640, the rail pressure is determined. From the gathered data, the slope 660 of the relationship between duty cycle and rail pressure can be calculated and used to find the transfer function, since the transfer function is an equation of a line. To find the equation of the line, first the slope may calculated as:

Slope=(FRP_2−FRP_1)/(DC_2−DC_1), wherein FRP_2=630 of FIG. 6, FRP_1=610,DC_2=640, and DC_1=620.

Next, the y-intercept (y-offset) is calculated using the found slope as:

*y*-intercept=FRP_1−(Slope*DC_1).

The last step is to determine the transfer function that defines the line 600 as:

FRP=Slope*DC+y-intercept, where FRP and DC correspond to the y-axis and x-axis variables, respectively. It is noted that the horizontal line 650 is a result of no data being available below the current HP pump fuel rail pressure. For example, if the FRP is allowed to drop to 20 bar, then no zero flow data is available below 20 bar. However, extrapolating the line 600 defined by the slop 660 to the x-axis allows the x-axis intercept to be computed.

Figure 7:
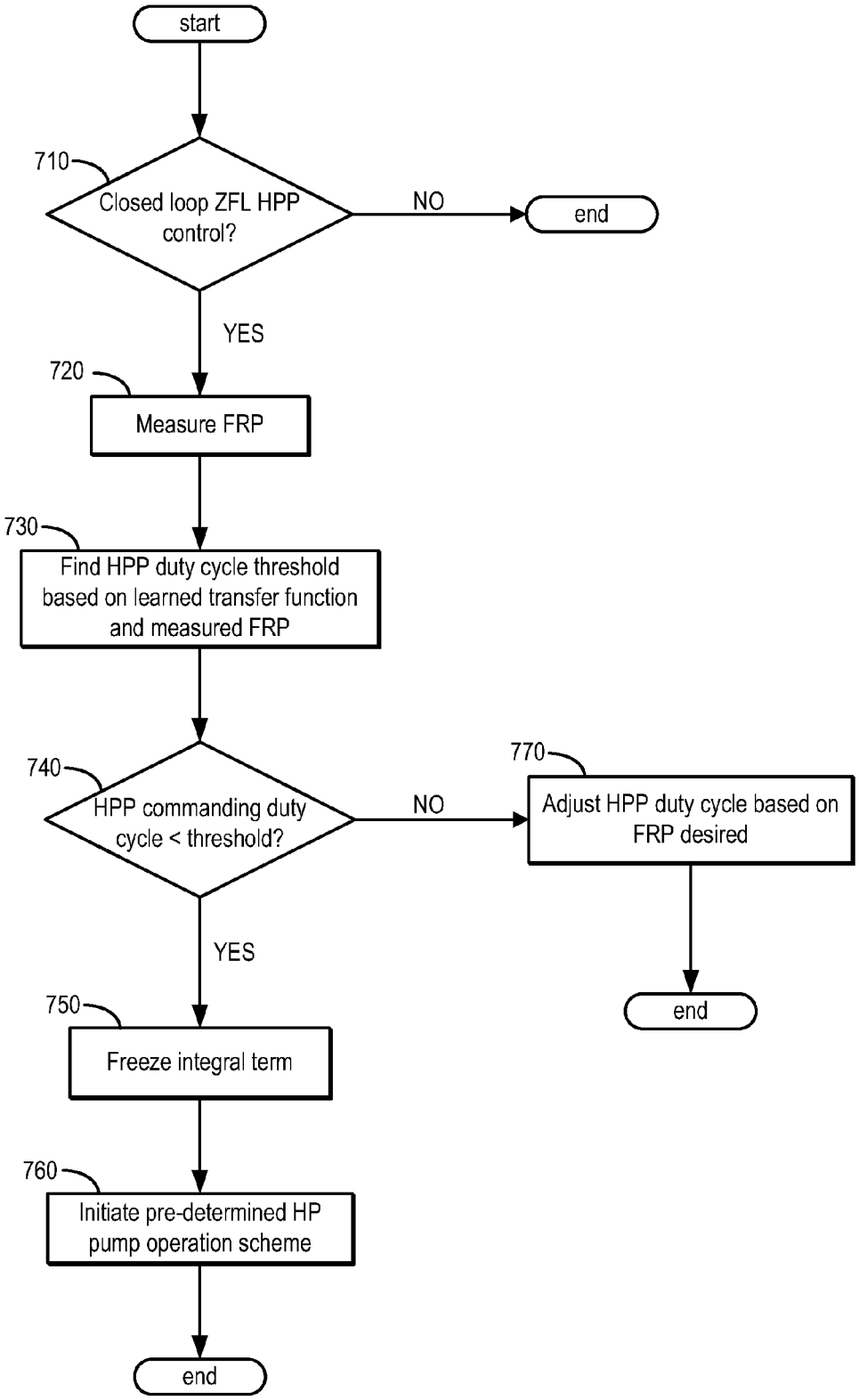
FIG. 7 shows a flow chart for an example high pressure pump operation with closed loop control during zero flow lubrication.

With the learned characteristics of the dead zone, a feedback pressure control system can be designed that does not expect system reaction while in the dead zone. FIG. 7 depicts a flow chart for general operation and control of the high pressure pump during zero flow lubrication once the transfer function (including the dead zone) of FIG. 5 is learned 530. The primary purpose of designing a new control system is to ensure that the control system integral term does not drastically increase (i.e. wind up) and force limit cycling due to no system response while in the dead zone. In this embodiment of HP pump operation, it is first determined whether or not the HP pump is in closed loop control during zero flow lubrication 710. If the HP pump is not in closed loop control during zero flow lubrication, then the process ends. Conversely, if closed loop control is activated during zero flow lubrication, then the fuel rail pressure is measured 720 to determine where the HP pump is operating. Next, using the learned transfer function and measured fuel rail pressure from step 720, the HP pump duty cycle threshold marking the beginning of the dead zone is found 730. In an ideal pumping environment as described previously, the fuel rail pressure increases with increasing pump duty cycle beginning with any duty cycle greater than 0%. However, upon learning the transfer function the real pump behavior near zero flow is quantified, wherein the dead zones prevent fuel rail pressure increase and are different depending on the initial fuel rail pressure. For example, the dead zone may start at 2% HP pump duty cycle of a 50 bar FRP, 4% for a 100 bar FRP, and 6% for a 150 bar FRP.

Next, if the controller is attempting to command a HP pump duty cycle greater than the threshold marking the beginning of the dead zone 740, then the HP pump performs its normal closed loop operation where the duty cycle is adjusted based on the desired fuel rail pressure 770. Conversely, if the controller is attempting to command a HP pump duty cycle less than the threshold, then the integral term is frozen 750. By freezing the integral term, the controller does not continuously change pump duty cycles within the dead zone, thereby reducing the previously described severe limit cycling. In one example, if the feedback fuel rail pressure controller is commanding a pump duty cycle of less than 4% with a fuel rail pressure of 100 bar, then the growth of the integral term is stopped, thus preventing limit cycling. Next, once the integral term is frozen 750, a pre-determined HP pump operating scheme may be started 760. The operation scheme may include a fixed pump duty cycle according to the engine conditions such as FRP, or a similar type of operation.

In addition to learning the transfer function for the purpose of not operating the pump within the dead zone, the disclosed learning method can be applied to a multitude of engine systems since the method is performed onboard the vehicle and is not a fixed calibration. This adaptive nature of the method allows pump response to variable factors such as pump/cam systems and fuel properties to be learnt onboard the vehicle. Furthermore, by learning the dead zone onboard the vehicle, one can be aware of system drift due to factors such as spill valve angular timing inaccuracies.

In this way, by learning the transfer function, the dead zone of the high pressure pump may also be learned so that the pump duty cycle can be adjusted in the dead zone. By modifying pump operation in the dead zone, the time for the pump to respond to changes in the direct injector fuel rail pressure can be improved. This method can reduce pump limit cycling while operating the pump in closed loop control, thereby reducing pump energy wastage while improving volumetric efficiency of the high pressure pump. By determining an accurate transfer function as shown in FIG. 5, an HP pump duty cycle can be scheduled that maximizes lubrication based on the rail pressure. Furthermore, the transfer function allows the variability of the pump response due to the variability between engine systems to be quantified. Overall, this learning method allows for improved zero flow lubrication, whereby pump operation is refined to reduce degradation of the high pressure pump.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

via a controller of an engine control system, decreasing fuel rail pressure below a threshold; then while not direct injecting fuel into an engine, learning a dead zone for a high pressure fuel pump based on a change in pump duty cycle relative to a resulting change in fuel rail pressure via the controller; and while direct injecting fuel into the engine and during closed-loop control of the fuel rail pressure, adjusting the pump duty cycle to stay above the learned dead zone via the controller.

2. The method of claim 1, wherein learning the dead zone based on the change in pump duty cycle relative to the resulting change in fuel rail pressure includes, via the controller:

commanding a first duty cycle and determining a first fuel rail pressure;

then commanding a second, higher duty cycle and determining a second fuel rail pressure; and learning the dead zone based on a difference between the first and second fuel rail pressures relative to a difference between the commanded first and second duty cycles.

3. The method of claim 1, wherein the high pressure fuel pump is coupled to a direct fuel injector of the engine, the engine further including a port fuel injector coupled to a low pressure fuel pump, and wherein not direct injecting fuel into the engine includes only port injecting fuel into the engine.

4. The method of claim 1, wherein the high pressure fuel pump is coupled to a direct fuel injector of the engine, and wherein not direct injecting fuel into the engine includes one of an engine-off condition and a deceleration fuel shut-off condition.

5. The method of claim 1, further comprising, via the controller, commanding a fixed pump duty cycle inside the dead zone, the fixed pump duty cycle based on a desired fuel rail pressure.

6. A method for an engine fuel system, comprising:

via a controller of an engine control system, learning an affine relationship between a duty cycle for a high pressure fuel pump and a fuel rail pressure for a direct fuel injector based on a change in the duty cycle relative to a resulting change in the fuel rail pressure during selected conditions when not direct injecting fuel into an engine; and adjusting the duty cycle of the high pressure fuel pump during closed-loop control of the fuel rail pressure based on the learned affine relationship to operate outside a dead zone of the high pressure fuel pump via the controller, wherein adjusting the duty cycle of the high pressure fuel pump during closed-loop control includes adjusting the duty cycle of the high pressure fuel pump while direct injecting fuel into the engine.

7. The method of claim 6, wherein the direct fuel injector is coupled to the high pressure fuel pump, and wherein the engine further includes a port fuel injector, and wherein the selected conditions include engine idling conditions where the fuel rail pressure is below a threshold, and the engine is fueled via the port injection only.

8. The method of claim 6, wherein the direct fuel injector is coupled to the high pressure fuel pump, and wherein the selected conditions include one of an engine-off condition and a deceleration fuel shut-off condition where the fuel rail pressure is below a threshold.

9. The method of claim 6, wherein learning the affine relationship includes, via the controller:

changing the duty cycle from a first, lower duty cycle to a second, higher duty cycle;

determining a first fuel rail pressure at the first duty cycle and a second fuel rail pressure at the second duty cycle;

determining a slope based on a difference between the first and second fuel rail pressures relative to the change in duty cycle; and learning an affine transfer function based on the determined slope.

10. The method of claim 9, wherein the learning includes calculating an offset based on the determined slope and learning the affine transfer function based on each of the determined slope and the calculated offset via the controller.

11. The method of claim 6, wherein the dead zone of the high pressure fuel pump is a region where an actual change in fuel rail pressure responsive to a change in pump duty cycle is lower than an expected change in fuel rail pressure.

12. An engine system, comprising:

an engine;

a direct fuel injector configured to direct inject fuel into the engine;

a high pressure fuel pump;

a fuel rail;

a pressure sensor configured to estimate a fuel rail pressure;

a controller with computer readable instructions stored in non-transitory memory for:

direct injecting fuel into the engine during engine idling conditions until the fuel rail pressure is below a threshold;

then, while not direct injecting fuel into the engine, commanding a change in duty cycle to the high pressure fuel pump and estimating a corresponding change in fuel rail pressure;

learning a dead zone of the high pressure fuel pump based on the change in fuel rail pressure relative to the change in commanded duty cycle; and upon learning the dead zone of the high pressure fuel pump, executing a programmed pump operating scheme.

13. The system of claim 12, wherein the controller includes further instructions for, while direct injecting fuel into the engine, adjusting the duty cycle of the high pressure fuel pump to operate outside the dead zone of the high pressure fuel pump, the dead zone being a zone where changes in pump duty cycle do not substantially change pump outlet pressure by more than a threshold.

14. The system of claim 13, wherein not direct injecting fuel into the engine includes operating the engine in a deceleration fuel shut-off mode.

15. The system of claim 13, further comprising a port fuel injector configured to port inject fuel into the engine, wherein not direct injecting fuel into the engine includes port injecting fuel into the engine.

16. The system of claim 15, wherein the dead zone of the high pressure fuel pump is a region where an actual change in fuel rail pressure responsive to a change in pump duty cycle is lower than an expected change in fuel rail pressure.

17. The system of claim 12, wherein the programmed pump operating scheme includes freezing an integral term of the controller.

* * * * *